US009802737B2

(12) United States Patent
Wuethrich

(10) Patent No.: US 9,802,737 B2
(45) Date of Patent: Oct. 31, 2017

(54) CONTAINER WITH CLOSURE CAP AND TAMPERPROOF RING

(71) Applicant: Hoffmann Neopac AG, Thun (CH)

(72) Inventor: Jan Wuethrich, Port (CH)

(73) Assignee: Hoffmann Neopac AG, Thun (CH)

( * ) Notice: Subject to any disclaimer, the term of this patent is extended or adjusted under 35 U.S.C. 154(b) by 5 days.

(21) Appl. No.: 15/107,667

(22) PCT Filed: Sep. 23, 2014

(86) PCT No.: PCT/CH2014/000136
§ 371 (c)(1),
(2) Date: Jun. 23, 2016

(87) PCT Pub. No.: WO2015/109412
PCT Pub. Date: Jul. 30, 2015

(65) Prior Publication Data

US 2016/0318668 A1 Nov. 3, 2016

(30) Foreign Application Priority Data

Jan. 21, 2014 (CH) ..... 0094/14

(51) Int. Cl.
*B65D 41/32* (2006.01)
*B65D 41/34* (2006.01)
(Continued)

(52) U.S. Cl.
CPC ..... *B65D 41/3414* (2013.01); *B65D 1/023* (2013.01); *B65D 1/0223* (2013.01);
(Continued)

(58) Field of Classification Search
CPC .. B65D 41/3414; B65D 1/0223; B65D 1/023; B65D 41/3404; B65D 1/08;
(Continued)

(56) References Cited

U.S. PATENT DOCUMENTS 4,415,094 A * 11/1983 Bavnsfelt ..... B65D 41/34 215/252
4,759,465 A * 7/1988 Landis ..... B65D 43/0243 215/256
(Continued)

FOREIGN PATENT DOCUMENTS

DE 10 2012 208 628 B3 7/2013
EP 0 413 466 A1 2/1991
(Continued)

OTHER PUBLICATIONS

International Search Report of PCT/CH2014/000136, dated Jan. 28, 2015.

*Primary Examiner* — Kareen Thomas
(74) *Attorney, Agent, or Firm* — Collard & Roe, P.C.

(57) ABSTRACT

The invention relates to a container (1) comprising a container body (4), a closure cap (3), which can be crewed onto said body, and a tamperproof ring (2), which is connected to said cap by way of breakaway webs (10). The closure cap (3) has first driver elements (18), which extend in the axial direction and, when the container (1) is opened for the first time, act on second ramp-like driver elements (19) of the tamperproof ring (2) that extend in the axial direction, and thereby push the tamperproof ring (2) away from the closure cap (3). On a shoulder (6) of the container body (4) that surrounds the container opening, two grooves (22.1, 22.2), one arranged above the other, are provided for receiving and engaging element (23) of the tamperproof ring. The engaging means is engaged first, upper groove (22.1) before the container (1) is opened for the first time and, as a result of the interaction of the driver elements (18, 19) on both sides, is engaged in the second, lower groove (22.2) after the container (1) is opened for the first time.

6 Claims, 8 Drawing Sheets

Figure 1:
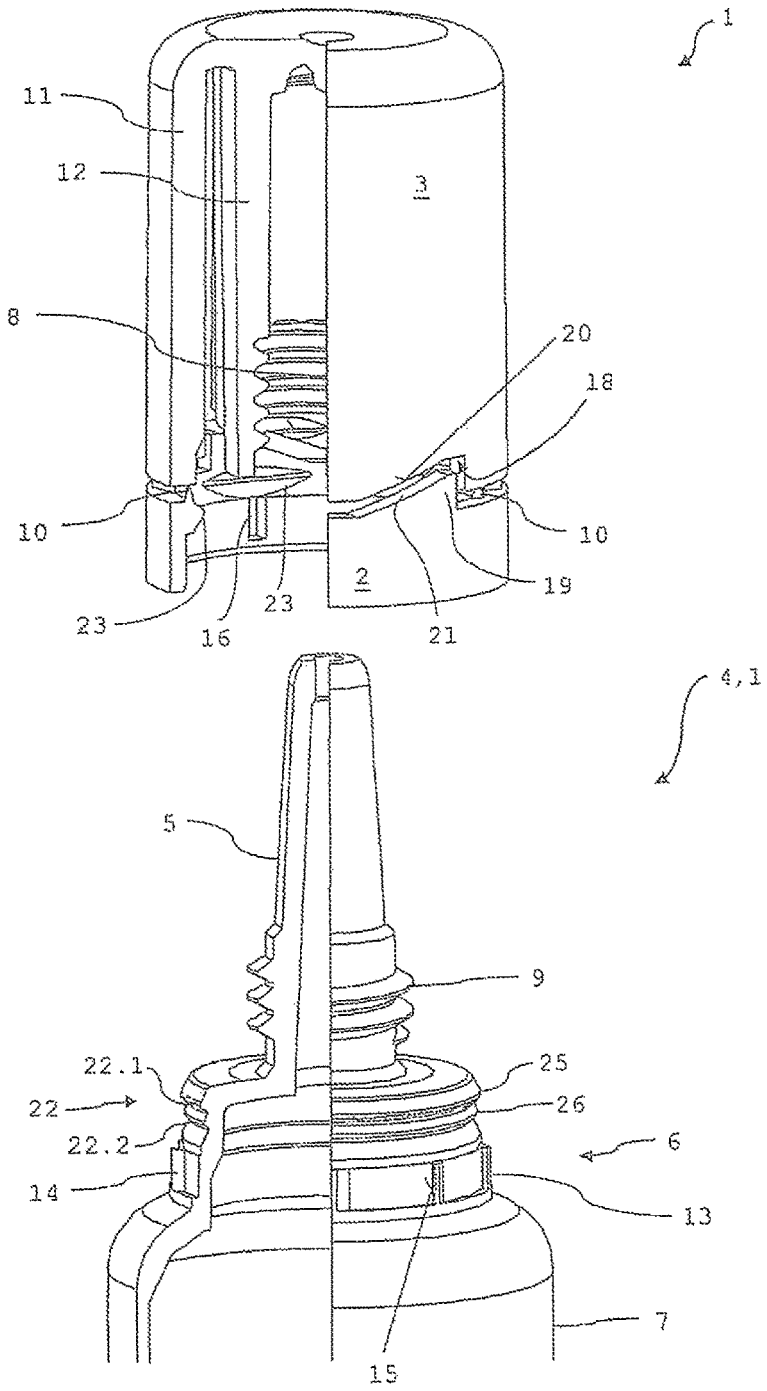

(51) Int. Cl.
*B65D 1/02* (2006.01)
*B65D 1/08* (2006.01)

(52) U.S. Cl.
CPC ..... *B65D 1/0246* (2013.01); *B65D 1/08* (2013.01); *B65D 41/3404* (2013.01); *B65D 41/3409* (2013.01); *B65D 2101/003* (2013.01); *B65D 2101/0015* (2013.01)

(58) Field of Classification Search
CPC ..... B65D 1/0246; B65D 41/3409; B65D 2101/003; B65D 2101/0015
USPC ..... 215/252, 254, 354, 217, 223, 250, 253, 215/256, 329, 330, 356, 220; 222/541.5; 220/265, 266, 270, 276
See application file for complete search history.

(56) References Cited

U.S. PATENT DOCUMENTS 5,046,646 A * 9/1991 Stull ..... B65D 47/12 215/252
5,121,859 A * 6/1992 Stull ..... B65D 47/12 215/252
5,251,769 A * 10/1993 Battegazzore ..... B65D 41/3409 215/252
5,285,912 A * 2/1994 Molinaro ..... B65D 41/3409 215/256
5,690,243 A * 11/1997 Molinaro ..... B65D 1/0246 215/256
6,039,199 A 3/2000 Jordi
6,223,919 B1 * 5/2001 Kuehn ..... B65D 41/0471 215/252
2005/0077264 A1 4/2005 Fuchs
2011/0100947 A1 5/2011 Long

FOREIGN PATENT DOCUMENTS

EP 0 450 959 A1 10/1991
EP 0 758 988 B1 9/1998
GB 2 163 413 A 2/1986
GB 2 249 303 A 5/1992
JP H07 101457 A 4/1995
WO 97/42092 A1 11/1997
WO 03/037737 A1 5/2003

* cited by examiner

CONTAINER WITH CLOSURE CAP AND TAMPERPROOF RING

CROSS-REFERENCE TO RELATED APPLICATIONS

This application is the National Stage of PCT/CH2014/000136 filed on Sep. 23, 2014, which claims priority under 35 U.S.C. §119 of Swiss Patent Application No. 0094/14 filed Jan. 21, 2014, the entire contents of which are incorporated herein by reference. The international application under PCT article 21(2) was not published in English.

TECHNICAL FIELD

The invention relates to a container according to the preamble of claim 1. The container may particularly be a tube.

BACKGROUND

Containers with closure caps are often used in the pharmaceutical, cosmetic and also in the food field, being formed in such a way that the user or the customer, respectively, can recognize if the container has already been open earlier. In the pharmaceutical and cosmetic field, the containers are often formed as tubes.

PRIOR ART

Such a container is e.g. known from the international patent application WO 03/037737 A1. The container described therein comprises a container body and a closure cap connected to a tamperproof ring via breakaway webs. The shoulder of the container body has barbs with leading ramps and keepout areas. The tamperproof ring has corresponding barbs on its inner side. When the closure cap is closed by rotation the leading ramps of the respective barbs glide over one another. When the closure cap is unscrewed, a mutual blocking due to the respective keepout areas occurs. In this way, the tamperproof ring is blocked relatively to the closure cap, such that the breakdown webs break (in this context also see GB 3 163 413 A). Furthermore, the closure cap has two diametrically opposed driver projections which have each an arc-shaped guide surface located each in front of a further arc-shaped guide surface of the tamperproof ring. This has the effect that the closure cap is guided over the driver projections during unscrewing and in this way the breakdown webs cannot be overstressed or damaged and in that only a relatively small force introduction is necessary when unscrewing the closure cap. However, for this type of container with tamperproof ring the first opening is not always clearly recognisable for the user.

The international patent application WO 97/42092 A1 also discloses a container with a tamperproof ring. A peel-off tab is connected to the tamperproof ring. On its inner side, the tamperproof ring has arresting members which engage corresponding arresting members of the container body. A closure cap is connected to the tamperproof ring via breakaway webs. In case of exerting a force on the peel-off tab, the breakaway webs are separated from the closure cap. However, the provision of a peel-off tab or of a tear-off web, respectively, has the disadvantages that the functionality of the tear-off web is often not understood by the user and that an additional component is necessary for opening the container, which has to be disposed of after the first opening.

The patent DE 10 2012 208 628 B3 discloses a closure cap with a tamperproof ring, wherein the tamperproof ring has a connection ring connected to the closure cap and a rim with the connection ring of tabs connected in an articulated way. When a container opening which comprises a neck with a projection is closed, the tabs are positioned against the inner circumferential surface of the connection ring and snap due to the resetting force when a snap position underneath the projection of the neck has been reached. The tabs engaging the neck underneath the projection form a type of barbs and block an axial removal of the tamperproof ring. When first opening the closure cap, the tamperproof ring is separated partially or entirely from the closure cap in a perceptible way, wherein the tamperproof ring remains either on the closure cap or on the container. Also in this case, the first opening may be hard to recognize, at least in case of an only partial separation of the tamperproof ring.

DESCRIPTION OF THE INVENTION

It is the objective of the invention to provide a container in case of which the first opening is easy to recognize and the closure cap is easy to handle.

This objective is reached by a container with the features of claim 1.

The container according to the invention comprises a container body, a closure cap and a tamperproof ring which is connected to said closure cap by way of breakaway webs. Arresting projections which protrude outwards are provided on a shoulder of the container body at a mutual distance in circumferential direction, formed in such a way that they interact with arresting projections protruding inwards and arranged at a mutual distance on the tamperproof ring. Such arresting projections are e.g. known from the above-mentioned WO 03/037737 A1.

The closure cap of the container according to the invention has furthermore one or more first driver elements extending in axial direction, which are formed in such a way that they act on one or more second driver elements of the tamperproof ring that extend in axial direction and consequently push the tamperproof ring away from the closure cap when the container is opened for the first time. The axial direction refers in the figures to the vertical direction or longitudinal direction, respectively.

Furthermore, the shoulder of the container body of the container according to the invention is provided with an annular engaging means serving for receiving at least an engaging element provided on the tamperproof ring, e.g. an annulus-segment-shaped engaging element (also called bounce segment, snap-in button or snap-in nose), during the first opening. The term "annulus-segment-shaped" shall also encompass annular engaging projections.

The annular engaging means of the shoulder of the container body comprises at least a first and a second annular groove for receiving the at least one engaging element provided on the tamperproof ring, during the first opening, wherein the at least one engaging element is formed as engaging projection.

In an embodiment, a first bounce ring and a second bounce ring are provided above the first groove and between the first groove and the second groove, above which the at least one engaging projection is shiftable.

The second annular groove is located at a distance from the first groove in axial direction, wherein the second groove is arranged farther away in axial direction from the closure cap than the first groove. Before the first opening of the container, the at least one engaging projection of the tamperproof ring is engaged in the first groove of the annular engaging means. After the first opening of the container, the at least one engaging projection of the tamperproof ring is engaged in the second groove, this being reached by an interaction of the one or more first driver elements of the closure cap with the one or the more second driver elements of the tamperproof ring. This means that the at least one engaging projection of the tamperproof ring is moved or shifted, respectively, from the first groove into the second groove during the first opening of the container. Certainly, it is also conceivable that the at least one engaging means of the shoulder is formed as engaging projection and the at least one engaging element of the tamperproof ring is formed as one or more annular grooves.

The arresting projections of the shoulder of the container body, which protrude outwards, have each a leading ramp and a keepout area; they can particularly be formed as elastic leaf springs.

Preferably, the arresting projections of the shoulder of the container body, which protrude outwards, as well as the arresting projections of the tamperproof ring, which protrude inwards, are formed in a resilient or elastic way, respectively, e.g. by using a suitable plastic material.

Preferably, the closing cap has two diametrically opposed first driver elements which act on corresponding second driver elements of the tamperproof ring during the first opening of the container.

The one or more first driver elements of the closure cap as well as the one or more second driver elements of the tamperproof ring preferably have each an inclined guide surface, the inclination angles of which correspond. By these guide surfaces a simplified interaction between the first and the second driver elements is reached. The inclined guide surfaces may run straight or curved.

The one or the more first driver elements of the closure cap are preferably each formed as driver recess extending in axial direction. Accordingly, the one or the more second driver elements of the tamperproof ring are preferably each formed as driver projection extending in axial direction. Alternatively, the one or the more first driver elements may each be formed as driver projection extending in axial direction and the one or the more second driver elements may preferably each be formed as driver recess extending in axial direction.

When the closure cap is applied for the first time on the container body, the tamperproof ring is still connected to the closure cap by the breakdown webs. The arresting projections of the tamperproof ring, which protrude inwards, glide over the arresting projections of the shoulder of the container body, which protrude outwards, when the closure cap is applied. This is particularly done in such a way that the arresting projections of the shoulder, which protrude outwards, preferably have each a leading ramp over which the arresting projections of the tamperproof ring, which protrude inwards, can glide. The arresting projections of the tamperproof ring, which protrude inwards, finally stop in the clearances located between the arresting projections of the shoulder, which protrude outwards. The closure cap and the container body are preferably formed in such a way that the closure cap is applied onto the container body and can be removed therefrom by screwing.

If the container is opened for the first time by moving the closure cap accordingly, the arresting projections of the tamperproof ring, which protrude inwards, get caught in the arresting projections of the shoulder, which protrude outwards, particularly in the preferably provided keepout areas of the latter, such that the tamperproof ring is stopped or blocked, respectively, with regard to its movement. Because the closure cap moves on, particularly continues rotating, this leads to a cut of the breakdown webs and hence to a separation of the tamperproof ring from the closure cap. Furthermore, this results in the one or more first driver elements of the closure cap acting on the one or more second driver elements of the tamperproof ring and pressing the tamperproof ring via the one or more second driver elements away from the closure cap, i.e. downwards. This results in turn in the at least one engaging element provided on the tamperproof ring being received by the annular engaging means provided on the shoulder of the container body, particularly locking into it and in this way being kept at a distance from the closure cap in axial direction.

As mentioned above, the annular engaging means of the shoulder of the container body has a first annular groove and a second annular groove, wherein the second groove is at a longer distance from the closure cap in axial direction than the first groove. The tamperproof ring or its at least one engaging element formed as engaging projection, respectively, is kept in the first groove before the first opening. If the tamperproof ring is pushed away downwards from the closure cap due to the interaction of the first and the second driver elements, the at least one engaging projection is pushed from the first groove into the second groove and engages in the second groove. This means that after the first opening, the at least one engaging projection is supported by the second groove—and therefore farther away from the closure cap than in the first groove.

By the additional latching/fixing of the tamperproof ring by means of the at least one engaging element into the engaging means of the shoulder of the container body, particularly in its second groove, the tamperproof ring is kept at a distance from the closure cap and therefore doesn't disturb during usage of the container. In this way, the ability to handle the closure cap is increased. Furthermore, a first opening gets simple and clearly recognizable by the user due to the latching/fixing of the tamperproof ring at a distance. Advantageously, not even a tear-off tab is required with the container according to the invention for the provision of the first opening warranty.

SHORT DESCRIPTION OF THE DRAWINGS

Figure 2:
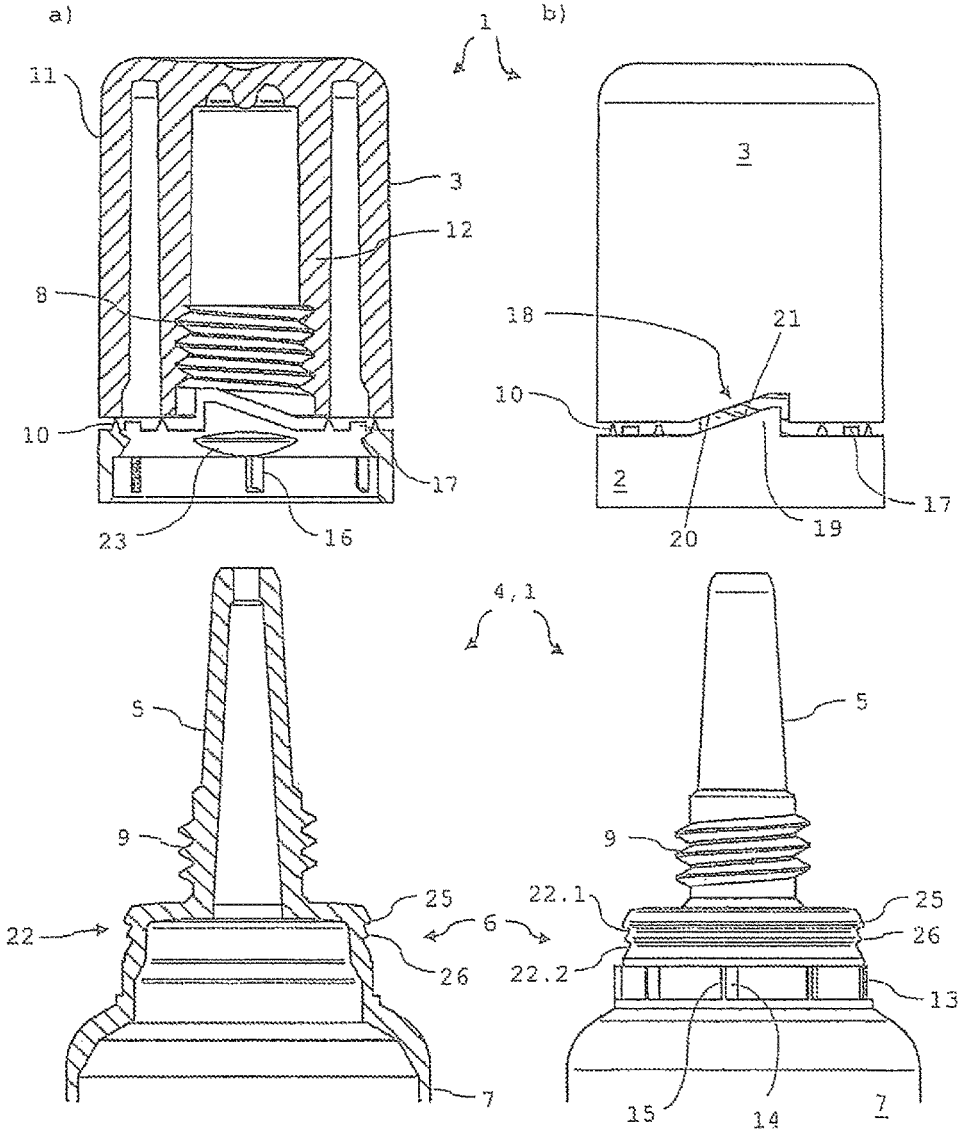
Figure 3:
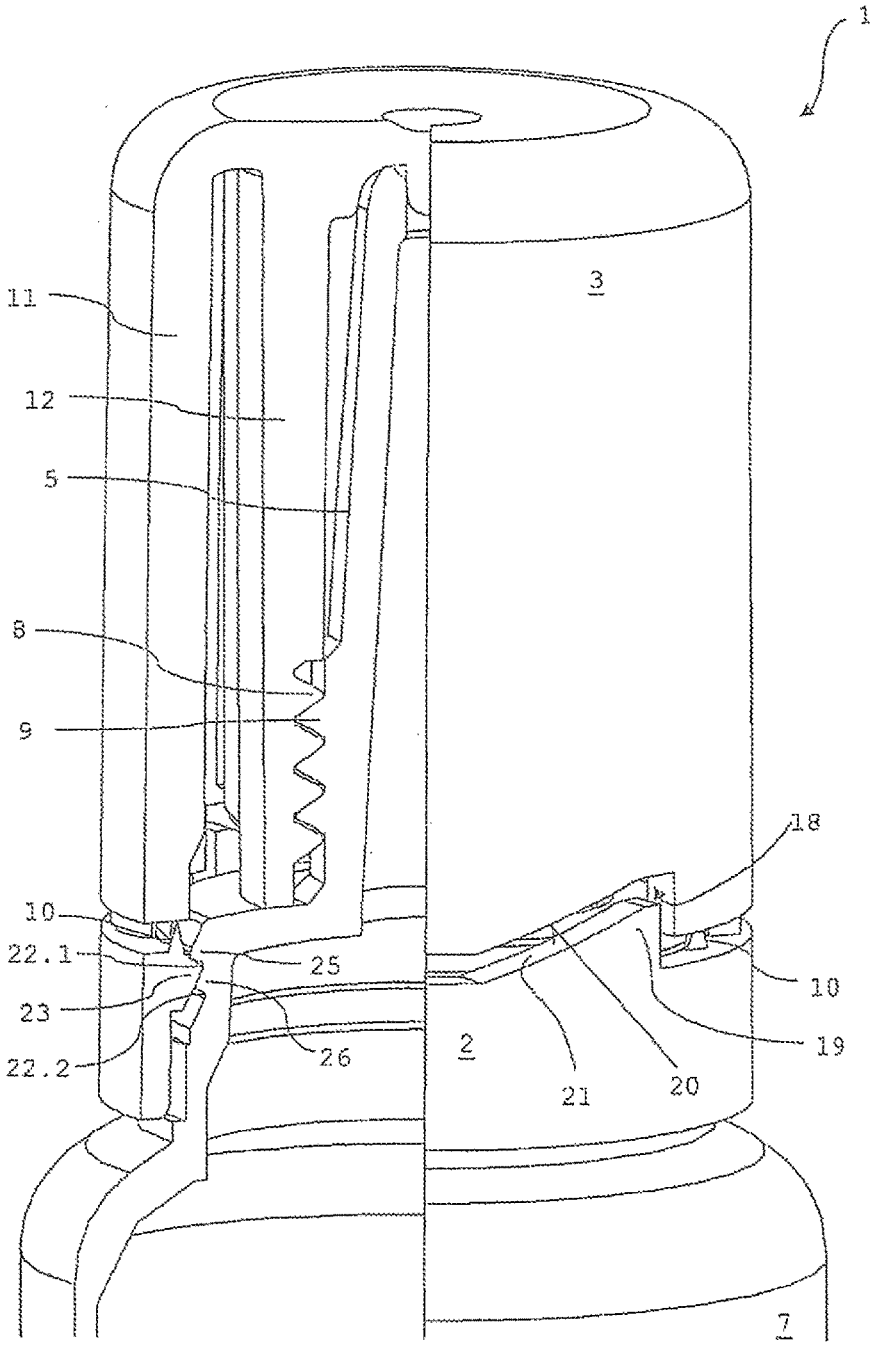
Figure 4:
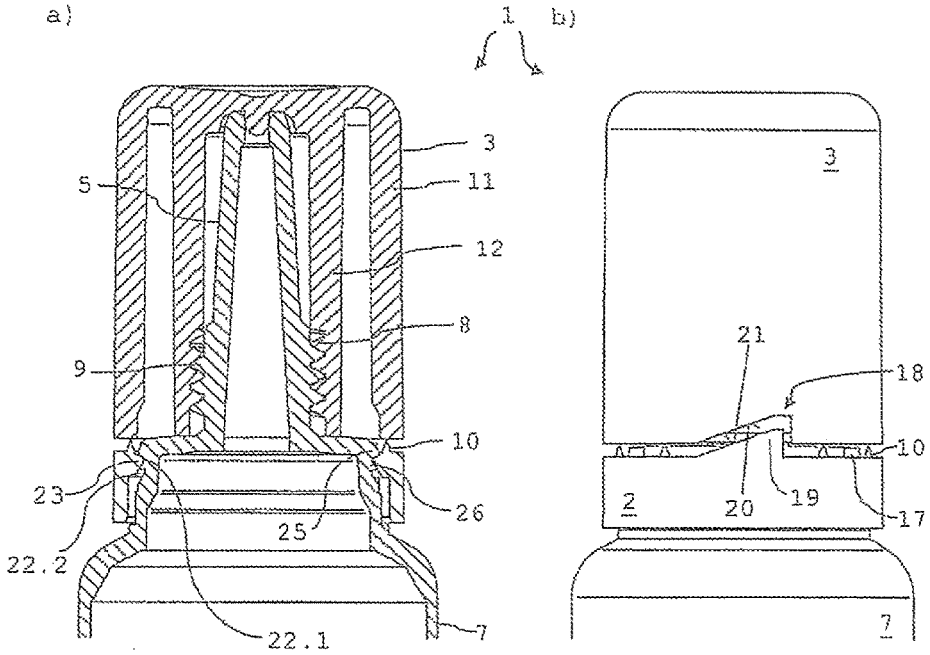
Figure 5:
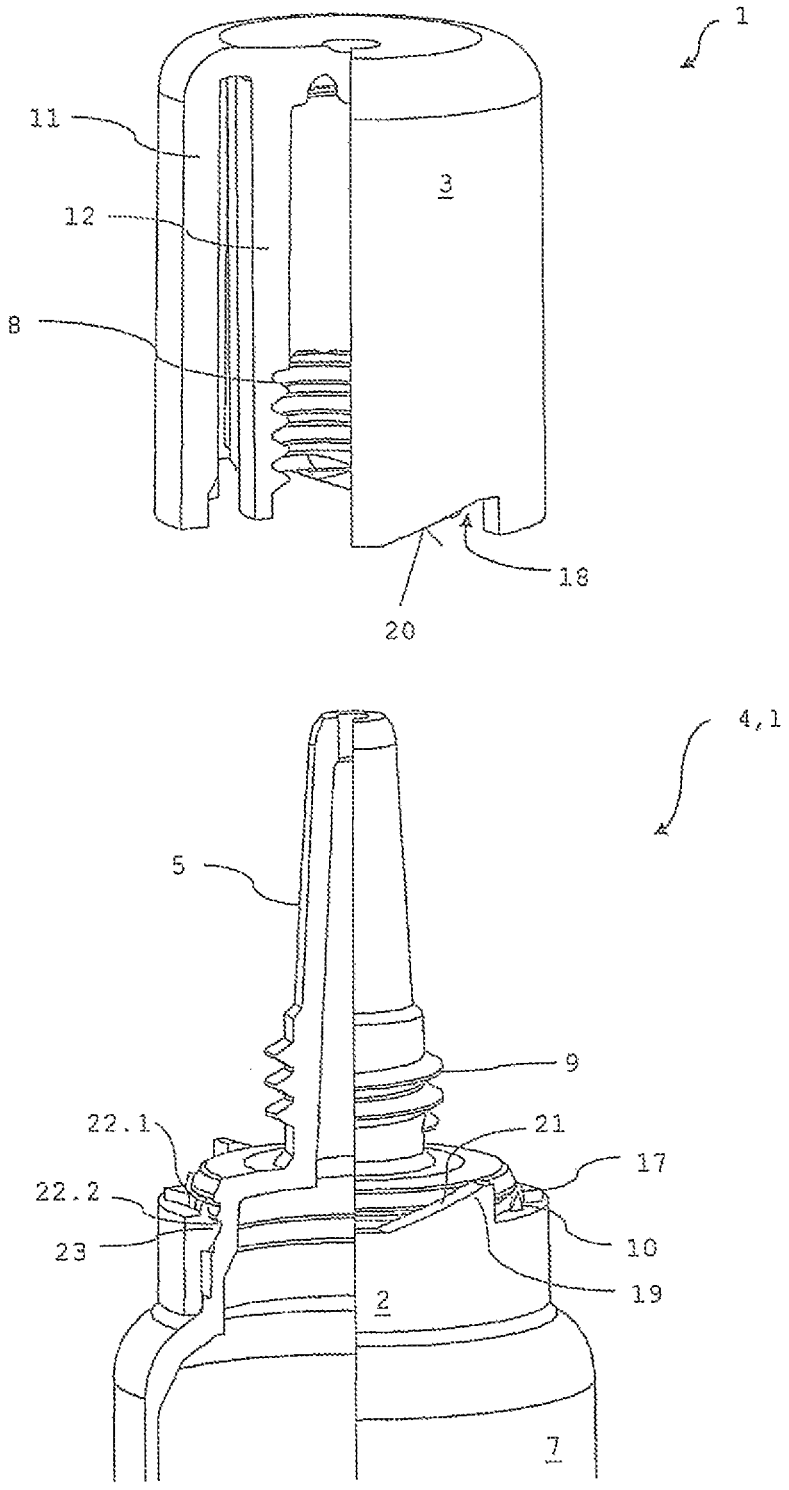
Figure 6:
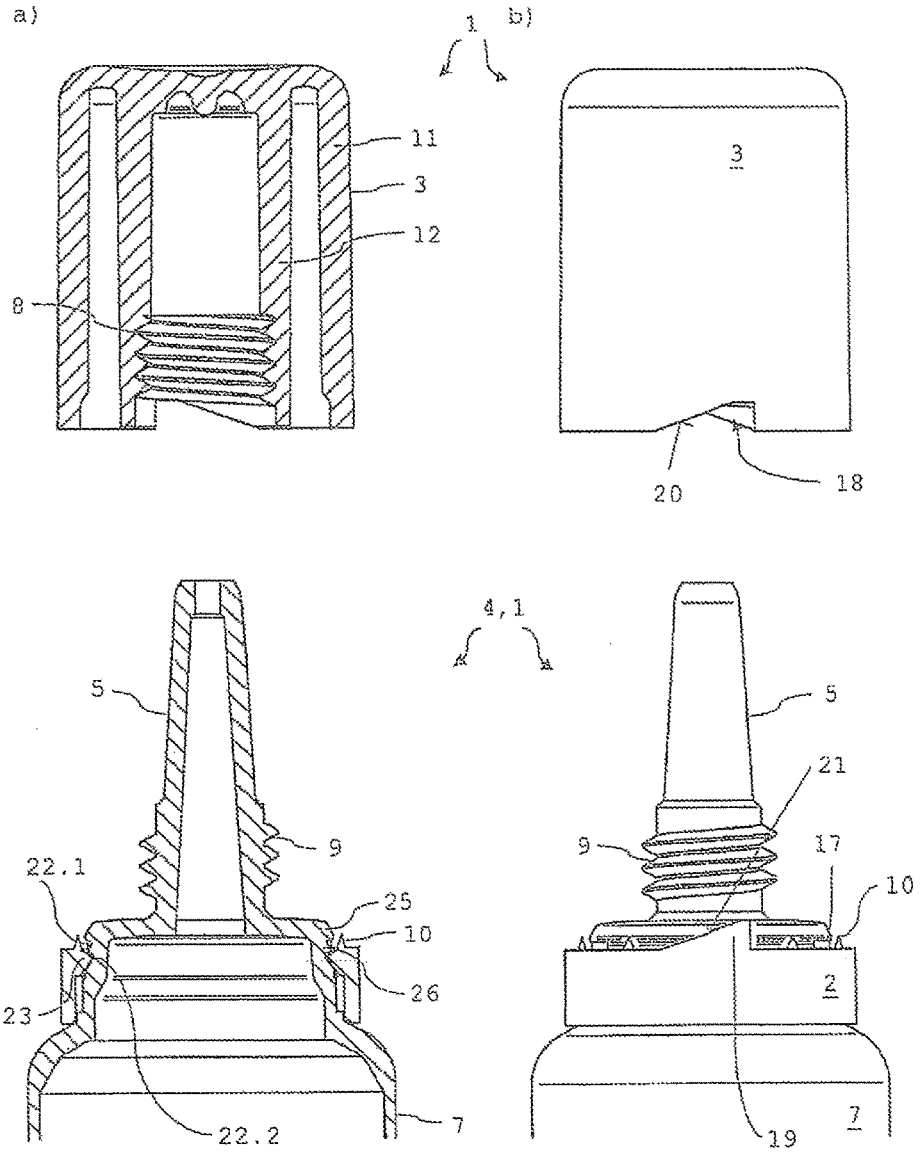
Figure 7:
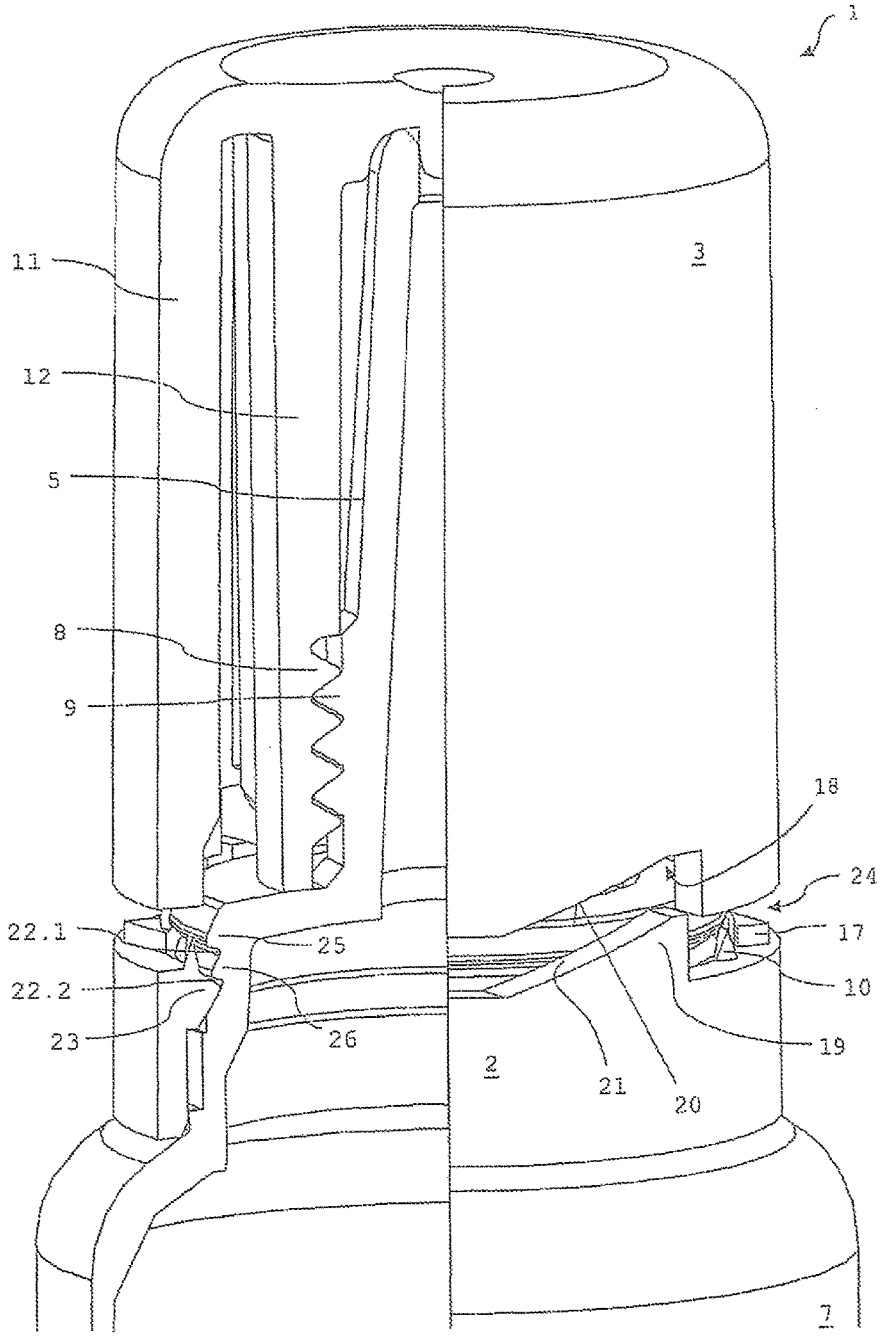
Figure 8:
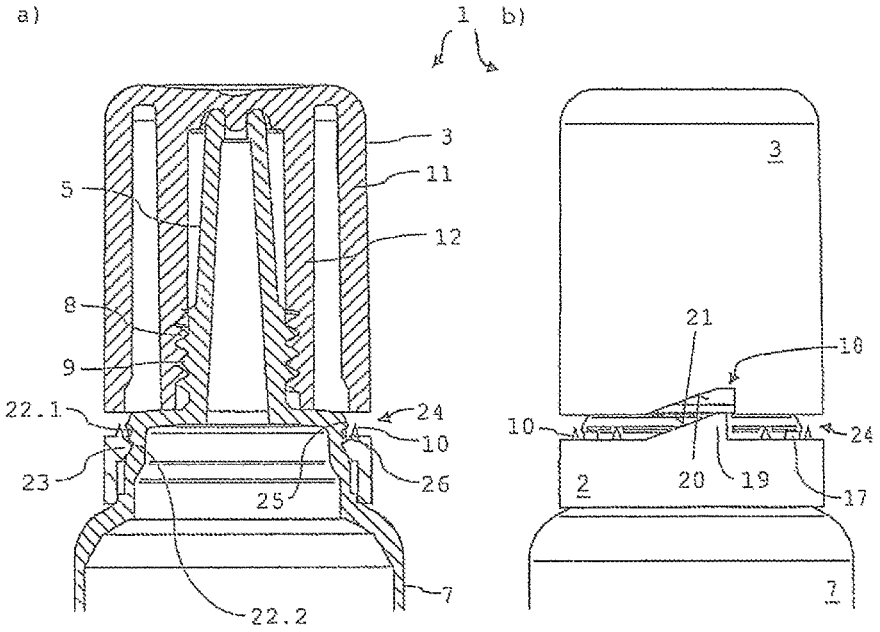

Further embodiments, advantages and applications of the invention result from the dependent claims and from the now following description by means of the drawings. It is shown in:

FIG. 1 a perspective partial section view of a container according to the invention before the closure cap with tamperproof ring is applied onto the container for the first time, flow chart of the method according to the invention and FIG. 2 a section view (FIG. 2*a*) and a side view (FIG. 2*b*) of a container according to the invention before the closure cap with tamperproof ring is applied onto the container for the first time, and FIG. 3 a perspective partial section view of a closed container according to the invention before the first opening, FIG. 4 a section view (FIG. 4*a*) and a side view (FIG. 4*b*) of a container according to the invention before the first opening, FIG. 5 a perspective partial section view of an opened container according to the invention, FIG. 6 a section view (FIG. 6*a*) and a side view (FIG. 6*b*) of an opened container according to the invention, FIG. 7 a perspective partial section view of a container according to the invention after the first opening, and FIG. 8 a section view (FIG. 8*a*) and a side view (FIG. 8*b*) of a closed container according to the invention after the first opening.

In the figures, same references denote same or similarly acting components. Due to reasons of simplifying the illustration, the figures only show the upper part of the container body, on which the closure cap in applied.

WAYS OF CARRYING OUT THE INVENTION

The figures show the container 1 according to the invention in different states: before applying the closure cap 3 still connected to the tamperproof ring 2 (FIGS. 1 and 2), closed before the first opening (FIGS. 3 and 4), opened (FIGS. 5 and 6) and closed after the first opening (FIGS. 7 and 8).

The container 1 according to the invention comprises a container body 4 with a container top 5 with an opening for dispensing the substance located inside the container 4, preferably formed as outlet spout. The outlet spout 5 is connected to a container trunk 7 via a shoulder 6 of the container body 4, in which the substance is located. The outlet spout 5 can be an outlet cannula. Furthermore, the container 1 comprises a closure cap 3 for closing the outlet spout 5 or the container 1, respectively, and a tamperproof ring 2. Before the first opening of the container 1, the tamperproof ring 2 is connected to the bottom (i.e. shoulder-sided) edge of the closure cap 3 via breakdown webs 10.

In order to apply the closure cap 3 onto the container body 4, the closure cap 3 preferably has a thread 8 on its inner side. Accordingly, the outlet spout 5 has a thread 9 on its outer side, such that the closure cap 3 can be screwed onto the container body 4 and can be unscrewed from it.

The closure cap 3 particularly has an outer shall 11 and an inner shell 12 which is located coaxially at a distance inside the outer shell 11, which are connected to one another at the upper end of the closure cap 3, away from the shoulder 6. The thread 8 is arranged in this case on the inner side of the inner shell 12, while the tamperproof ring 2 is connected to the bottom edge of the outer shell 11 of the closure cap 3 via the breakdown webs 10.

Arresting projections 13 are provided on the shoulder 6 of the container body 4, protruding outwards at a mutual distance in circumferential direction. The arresting projections 13 preferably have each a leading ramp 14 and a keepout area 15, which are formed by opposed sides of the respective arresting projection 13. The tamperproof ring 2 has on its inner side arresting projections 16 at a mutual distance, protruding inwards, which are provided for interacting with the arresting projections 13 of the shoulder 6 (see FIGS. 1 and 2). The arresting projections 16 may also have a leading ramp and a keepout area (not specified in detail). The arresting projections 13 and/or 16 are preferably elastic.

When first screwing the closure cap 3, which is still connected to the tamperproof ring 2 via the breakdown webs 10, onto the container body 4, the arresting projections 16 glide over the arresting projections 13, particularly over their leading ramps 14. If after that the closure cap 3 shall afterwards be unscrewed from the container body 4, the closure cap 3 is turned in opposite direction and the arresting projections 16 get caught on the arresting projections 13, particularly on their keepout areas 15, such that they cannot be moved beyond the arresting projections 13.

Spacers 17 are preferably provided at the upper, i.e. closure-sided, edge of the tamperproof ring 2, in order to avoid that the closure cap 3 and the tamperproof ring 2 are pressed on one another too much during unscrewing (see amongst others FIGS. 2 and 4). Alternatively, the spacers 17 may also be provided at the bottom end of the closure cap 3, particularly of its outer shell 11.

The closure cap 3 has first driver elements 18 which are provided to interact with corresponding second driver elements 19 of the tamperproof ring 2 during the first opening of the container 1 (see particularly FIGS. 3 and 4). Preferably, two opposed driver elements 18, 19 are respectively provided. The driver elements 18 of the closure cap 3 preferably extend from the bottom, i.e. shoulder-sided, edge of the closure cap 3, particularly of its outer shell 11, in axial direction upwards. The driver elements 18 of the closure cap 3 are preferably each formed as driver recess which preferably has an inclined guide surface 20. The driver elements 19 of the tamperproof ring 2 are preferably each formed as driver projection extending in axial direction, particularly as driver wedge, which preferably also has an inclined guide surface 21. The guide surfaces 20, 21 preferably have the same inclination. Before and during the first application of the closure cap 3 connected to the tamperproof ring 2 onto the container body 4, the driver projections 19 protrude into the driver recesses 18, wherein preferably the guide surfaces 20, 21 run in a parallel way. This means that the tamperproof ring 2 and the closure cap 3 are connected via the breakdown webs 10 in such a way that the driver projections 19 protrude into the driver recesses 18.

When the container 1 is opened the first time, the arresting projections 16 of the tamperproof ring 2 get caught into the arresting projections 13 of the shoulder 6, as described above, such that the tamperproof ring 2 cannot rotate farther, even when the closure cap 3 is further unscrewed. This results in the breakdown webs 10 breaking or being torn, respectively, when the closure cap 3 is further unscrewed, such that the tamperproof ring 2 is separated from the closure cap 3. Furthermore, the driver recesses 18 act or press, respectively, on the driver projections 19 or their guide surfaces 21, respectively, via their guide surfaces 20, such that the driver projections 19 and consequently the tamperproof ring 2 is pushed downwards, i.e. away from the closure cap 3.

The shoulder 6 of the container body 4 has an annular engaging means 22 for receiving engaging projections 23 arranged on the inner side of the tamperproof ring 2. The engaging means 22 comprises a first annular groove 22.1 and a second annular groove 22.2, which are arranged at a mutual distance on the shoulder 6. The second annular groove 22.2 is arranged farther away in axial direction from the closure cap 2 than the first annular groove 22.1.

When the closure cap 3, which is still connected to the tamperproof ring 2 via the breakdown webs 10, is screwed onto the container body 4 for the first time, the engaging projections 23 of the tamperproof ring 2 snap into the first groove 22.1 (see FIGS. 3 and 4). If now the container 1 is opened for the first time by unscrewing the closure cap 3, this results in the driver recesses 18 of the closure cap 3 pushing down the driver projections 19 of the tamperproof ring 2, as described above. By this pressing downwards of the tamperproof ring 2, the engaging projections 23 are also pushed downwards and are shifted from the first groove 22.1 into the second groove 22.2, such that the engaging projections 23 snap into the second groove 22.2 (see FIGS. 5 and 6). Above the first groove 22.1 and between the first groove 22.1 and the second groove 22.2, bounce rings 25, 26 are provided, over which the engaging projections 23 is each pressed. This means that during the first application of the closure cap 3 with the tamperproof ring 2, the engaging projections 23 are pushed over the first bounce ring 25. During the first opening, the engaging projections 23 are then pushed further from the first groove 22.1 over the second bounce ring 26 into the second groove 22.2.

If the closure cap 3 is again screwed onto the container body 4 after the first opening, the tamperproof ring 3 doesn't disturb because it has snapped via its engaging projections 23 into the second groove 22.2 which is farther away from the closure cap 3 (see FIGS. 7 and 8). Between the closure cap 3 screwed on again and the tamperproof ring 2 there is now a clearance 24 which is easily recognizable by the user and which shows him that the container 1 has already been opened at least once. The clearance 24 is larger in axial direction than the breakdown webs 10. The axial extension of the second driver elements 19, which are preferably formed as driver projections, is particularly not larger than the clearance 24. By keeping the tamperproof ring 2 in the second groove 22.2 it is undetachable.

While preferred embodiments of the invention are described in the present application, it is clearly noted that the invention is not limited thereto and may be carried out in other ways within the scope of the now following claims. Terms like "particularly", "advantageous", etc. used in the description refer only to optional and exemplary embodiments.

The invention claimed is:

1. Container with a container body (4), a closure cap (3) and a tamperproof ring (2), which is connected to said closure cap (3) by way of breakaway webs (10), wherein arresting projections (13) which protrude outwards are provided on a shoulder (6) of the container body (4) at a mutual distance in circumferential direction, formed in such a way that they interact with arresting projections (16) protruding inwards and arranged at a mutual distance on the tamperproof ring (2), wherein the closure cap (3) has one or more first driver elements (18) extending in axial direction, which are formed in such a way that they act on one or more second driver elements (19) of the tamperproof ring (2) that extend in axial direction, when the container (1) is opened for the first time, and thereby push the tamperproof ring (2) away from the closure cap (3), wherein the shoulder (6) of the container body (4) is provided with an annular engaging means (22; 22.1, 22.2) for receiving at least an engaging element (23) provided on the tamperproof ring (2), during the first opening, wherein the annular engaging means (22; 22.1, 22.2) of the shoulder (6) of the container body (4) has at least a first and a second annular groove (22.1, 22.2) for receiving the at least one engaging element (23) of the tamperproof ring (2) when the container (1) is opened for the first time, wherein the at least one engaging element (23) of the tamperproof ring (2) is formed as engaging projection, wherein the second annular groove (22.2) is located at a distance from the first groove (22.1) in axial direction, wherein the second groove (22.2) is arranged farther away in axial direction from the closure cap (3) than the first groove (22.1) and wherein the at least one engaging projection (23) of the tamperproof ring (2) is engaged in the first groove (22.1) before the first opening of the container (1) and as a result of the interaction of the one or more first driver elements (18) of the closure cap (3) with the one or the more second driver elements (19) of the tamperproof ring (2) is engaged in the second groove (22.2) after the container (1) is opened for the first time.

2. Container according to claim 1, wherein the one or more first driver elements (18) of the closure cap (3) as well as the one or more second driver elements (19) of the tamperproof ring (2) have each an inclined, particularly straight or curved guide surface (20; 21).

3. Container according to claim 2, wherein the one or the more first driver elements (18) of the closure cap (3) are each formed as driver recess extending in axial direction and in that the one or the more second driver elements (19) of the tamperproof ring (2) are each formed as driver projection extending in axial direction.

4. Container according to claim 1, wherein the arresting projections (13) of the shoulder (6) of the container body (4), which protrude outwards, have each a leading ramp (14) and a keepout area (15).

5. Container according to claim 1, wherein the arresting projections (13) of the shoulder (6) of the container body (4), which protrude outwards, as well as the arresting projections (16) of the tamperproof ring (2), which protrude inwards, are formed in a resilient way.

6. Container according to claim 1, wherein a first bounce ring (25) and a second bounce ring (26) are provided above the first groove (22.1) and between the first groove (22.1) and the second groove (22.2), above which the at least one engaging projection (23) is shiftable.

* * * * *